US007465360B2

(12) United States Patent
Scribner

(10) Patent No.: US 7,465,360 B2
(45) Date of Patent: Dec. 16, 2008

(54) METHODS FOR REMOVING A DISPERSED LUBRICIOUS COATING FROM A SUBSTRATE

(75) Inventor: Cliff J. Scribner, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 29 days.

(21) Appl. No.: 11/381,232

(22) Filed: May 2, 2006

(65) Prior Publication Data

US 2006/0283481 A1 Dec. 21, 2006

Related U.S. Application Data

(60) Provisional application No. 60/676,714, filed on May 2, 2005.

(51) Int. Cl.
*B08B 3/00* (2006.01)

(52) U.S. Cl. ..... 134/26; 134/6; 134/7; 134/42

(58) Field of Classification Search ..... 134/6, 134/7, 26, 42

See application file for complete search history.

(56) References Cited

U.S. PATENT DOCUMENTS

| | | | | |
|---|---|---|---|---|
| 3,562,193 | A | 2/1971 | Leeks et al. | 410/133 |
| 3,983,213 | A | 9/1976 | Lissant | 514/789 |
| 4,069,186 | A | 1/1978 | Ramig | 523/221 |
| 4,161,280 | A * | 7/1979 | Kasinskas | 239/1 |
| 4,345,949 | A * | 8/1982 | Park et al. | 134/22.16 |
| 4,450,197 | A | 5/1984 | Hager et al. | 442/188 |
| 4,493,777 | A | 1/1985 | Snyder et al. | 508/472 |
| 4,541,947 | A | 9/1985 | Clark et al. | 516/10 |
| 4,604,411 | A | 8/1986 | Yada et al. | 522/14 |
| 4,606,834 | A | 8/1986 | Hart et al. | 508/471 |
| 4,606,913 | A | 8/1986 | Aronson et al. | 424/52 |
| 4,650,596 | A | 3/1987 | Schlueter et al. | 508/471 |
| 4,664,823 | A | 5/1987 | Kuwamoto et al. | 508/190 |
| 4,673,516 | A | 6/1987 | Berry | 508/214 |
| 4,781,847 | A | 11/1988 | Weitz | 508/216 |
| 4,849,171 | A * | 7/1989 | Murray | 422/7 |
| 5,114,849 | A | 5/1992 | Ben-Bassat et al. | 435/101 |
| 5,171,781 | A | 12/1992 | Farrar et al. | 524/547 |
| 5,190,679 | A | 3/1993 | McDonald | 508/178 |
| 5,209,860 | A | 5/1993 | Trivett | 156/441.5 |
| 5,258,424 | A | 11/1993 | Yagi et al. | 523/221 |
| 5,338,129 | A | 8/1994 | Oden | 404/9 |
| 5,376,142 | A | 12/1994 | Matthews et al. | 8/94.18 |
| 5,384,343 | A | 1/1995 | Farrar et al. | 523/129 |
| 5,470,498 | A | 11/1995 | Pialet et al. | 252/76 |
| 5,639,796 | A | 6/1997 | Lee | 514/773 |
| 5,709,813 | A * | 1/1998 | Janke et al. | 252/70 |
| 5,834,553 | A | 11/1998 | Roberts et al. | 524/577 |
| 5,863,875 | A | 1/1999 | Steckel | 508/551 |
| 5,922,240 | A * | 7/1999 | Johnson et al. | 252/70 |
| 5,962,578 | A | 10/1999 | Beihoffer et al. | 524/521 |
| 6,031,041 | A | 2/2000 | Chung et al. | 524/507 |
| 6,034,041 | A | 3/2000 | Nittel et al. | 508/474 |
| 6,149,833 | A * | 11/2000 | Dietl et al. | 252/70 |
| 6,149,970 | A | 11/2000 | Frigge et al. | 427/154 |
| 6,197,382 | B1 | 3/2001 | Ornstein et al. | 524/544 |
| 6,242,489 | B1 | 6/2001 | Pinney | 514/562 |
| 6,271,184 | B1 | 8/2001 | Seebauer et al. | 508/469 |
| 6,440,225 | B1 | 8/2002 | Van Den Burg et al. | 134/6 |
| 6,641,753 | B1 * | 11/2003 | Bloomer | 252/70 |
| 6,689,200 | B2 | 2/2004 | Scarborough et al. | 106/2 |
| 6,784,141 | B1 | 8/2004 | King et al. | 507/222 |
| 7,067,464 | B2 | 6/2006 | Mallow et al. | 508/551 |
| 2004/0059043 | A1 | 3/2004 | Mallow et al. | 524/502 |
| 2004/0151909 | A1 | 8/2004 | Mathis et al. | 428/403 |

FOREIGN PATENT DOCUMENTS

| | | |
|---|---|---|
| DE | 1644976 | 10/1971 |
| DE | 2554082 | 6/1977 |
| DE | 19638743 A * | 3/1998 |
| EP | 0041834 | 8/1984 |
| EP | 0341577 | 9/1990 |
| EP | 1160299 | 12/2001 |
| FR | 2753986 | 4/1998 |
| GB | 1312083 | 4/1973 |
| GB | 1562417 | 3/1980 |
| JP | 02042351 | 3/1980 |
| JP | A-6-293875 | 10/1994 |
| WO | WO 91/15434 | 10/1991 |
| WO | WO 92/07924 | 5/1992 |
| WO | WO 98/51731 | 11/1998 |
| WO | WO 03/050192 | 6/2003 |

OTHER PUBLICATIONS

Cytec Industries, "Suprefloc flocculants dry polyacrylamids (PAM), anionic/nonionic: A-100/N-300 Series," www.cytec.com, 1997.

* cited by examiner

*Primary Examiner*—Sharidan Carrillo
(74) *Attorney, Agent, or Firm*—Grossman Tucker et al.

(57) ABSTRACT

The present invention relates generally to methods of removal of a lubricious coating. In more specific aspects, the invention relates to methods of removal of aqueous polymers comprising acrylamide or copolymers thereof from a substrate comprising application of one or more metal salts.

28 Claims, No Drawings

METHODS FOR REMOVING A DISPERSED LUBRICIOUS COATING FROM A SUBSTRATE

This application claims the benefit of U.S. Provisional Application No. 60/676,714, filed May 2, 2005. The entire text of the above provisional application is specifically incorporated by reference.

BACKGROUND OF THE INVENTION

A. Field of the Invention

The present invention relates generally to methods of removal of a lubricious coating. In more specific aspects, the invention relates to methods of removal of aqueous polymers comprising acrylamide or copolymers thereof from a substrate comprising the application of one or more metal salts.

B. Background of the Invention

Lubricious coatings ("LC's") generally impede a person's traversing, holding or otherwise gaining traction on a surface due to abrupt movements. One suitable use of LC's is as a non-lethal method of crowd control. Crowd and riot control is a concern for law officials at every level of government: local, national and international. Attempts at controlling unruly gatherings and defending selected areas from such crowds have resulted in physical and psychological injury to members of the law community and the crowds alike. Suitable LC's, sometimes also called anti-traction materials or ATMs, are disclosed in U.S. Application Publication Numbers 2003/0144407, 2004/0059043, and 2004/0151909.

Non-lethal weapon systems now represent an important alternative for law enforcement officials and strategic defense purposes. In order to ensure the most desirable outcome in managing crowd control, it is desired that numerous alternatives to non-lethal weapons systems be available along a force continuum, such that a non-lethal weapon suitable for a particular application may be selected based upon the nature of the threat and level of provocation. LC's provide a method of slowing, impeding and/or eliminating the forward progress and abrupt movement of rowdy crowds.

LC's may be used to slow or hinder the forward movement of others in several ways. For example, the LC may be positioned in or around an area into which it is desirable to keep others from entering. The LC may preferably be positioned on hard surfaces such as concrete, asphalt, tile, wood, compacted soils, etc. When the LC is positioned on such a surface, it is extremely difficult, if not impossible, to enter into the restricted area by traversing over or through the LC as a person or vehicle is unable to obtain traction or friction. As such, the person is unable to propel or negotiate rapid movement in any direction, forward, back, etc., since the force of friction between the body and the LC is so minuscule.

However, after use, the LC must be cleaned-up and removed. Current methods of removal of LC's include the use of high-pressure washer systems, suitably when the LC is dispersed onto a hard surface such as asphalt, brick, smooth concrete, broomed finish concrete or the like. Pressure washing with a water stream is effective. However, it is very time consuming and requires large amounts of water and effort to complete the removal process. Soft surfaces such as compacted soil or grass require the use of a tractor dozer or similar equipment and/or hand shovel and dozer as needed to mix and plow the diluted LC in the soil or into a dump truck for removal to another site. Yet another time-consuming and work-intensive LC removal method for hard surfaces uses a scraper which can be used in combination with a wet sponge or wet emery cloth pad, suitably used on smooth floor tile, smooth concrete, brick, floor vinyl, wood surfaces or the like.

The process includes the use of a scraper first, then use of a wet sponge/emery cloth-pad with a 3- to 5-gallon bucket of water. Next, the sponge or pad combination is used in conjunction with the fresh bucket of water (each square foot cleaned) to repeatedly wipe the surface until all the LC is removed. This procedure is repeated until the surface is completely clean and a re-wet test shows that there is no indication of any residual surface slipperiness. As an alternative, one could opt to scrape the dry LC into a pile from these surfaces first and then follow-up with a wet sponge or wet emery cloth-pad to completely clean the surface of remaining wet LC. This however, is also a very time and work-intensive removal process.

Such cleanup methods are work-intensive and use of implements such as a scraper may permanently destroy surfaces and finishes on substrates such as vinyl, wood, tile or the like. There is currently a need for clean-up methods that require less physical force to remove the LC, thus making the process less work-intensive, less time-intensive, use less water and less likely to cause damage to the substrate upon which the LC was dispersed.

SUMMARY OF THE INVENTION

The present invention provides methods wherein dispersed LC of any of the types disclosed herein is rendered more amenable to clean-up and removal. In some preferred aspects of the invention, the LC is specifically not a coating of ice or a coating predominantly of ice. In other respects, LC's encompassed by the present invention suitably include a lubricious coating wherein application of a metal salt alters the physical properties of such lubricious coating such as to render it more amenable to being cleaned-up and removed. One aspect of the present invention provides methods for removing a lubricious coating, such as a dispersed LC, from a substrate, comprising applying an effective amount of a composition comprising a metal salt to the lubricious coating. In some embodiments, the lubricious coating comprises water and a polymer, wherein in some embodiments the polymer may comprise an anionic acrylamide polymer, an acrylate polymer or a copolymer of polyacrylamides, polyacrylates, or polyacrylic acids or combinations thereof. In some embodiments, the substrate is a horizontal surface, a vertical surface or a sloping surface, or the surface of a building structure, a tool, or machinery.

In some embodiments, e.g., the substrate may be asphalt, concrete, brick, tile, or wood.

In some embodiments the metal salt is an alkali metal or alkaline earth metal salt, which may be a sodium salt, a potassium salt, or a calcium salt, that in typical embodiments may be sodium chloride, potassium chloride, or calcium chloride. Some embodiments further comprise a second metal salt. In various embodiments, the composition comprising a metal salt may be a crystalline material, an aqueous slurry, or a dissolved solution. In some embodiments, the slurry is composed of about 85% by weight of metal salt or less with the balance of the composition being composed of water and, optionally, the inclusion of any other ingredient that will not interfere with the performance of the metal salt. In typical embodiments, the crystalline material comprises sodium chloride, potassium chloride, or calcium chloride. In embodiments wherein the crystalline material is a particulate material, the mean particle size is within the range of from about 0.01 mm to about 1.50 mm. Embodiments include wherein the mean particle shape substantially irregular, i.e., the shape is visibly asymmetrical when viewed by a scanning electron microscope, optical microscope, or other suitable visualization method. Further, the same is true if the particle shape is substantially spherical. In some embodiments the composition comprising a metal salt is applied such that about 6 to about 28 grams of metal salt, or about 11 to about 22 grams of metal salt, is applied per square foot of surface coated with lubricious coating. Some embodiments also encompass admixing the applied composition comprising a metal salt with the lubricious coating and/or physical removal of the lubricious coating, including by use of a high-pressure washer water stream, wet sponge, hand held or broom handled squeegee, push broom, scraper, or a garden hose water stream.

Another aspect of the invention comprises a method of removing a lubricious coating from a substrate comprising: (a) application of an effective amount of a metal salt to the surface of said lubricious coating; (b) admixing the metal salt with said lubricious coating; and (c) physically removing the admixture of the metal salt and lubricious coating from the substrate. In some embodiments, the lubricious coating comprises water and a polymer or copolymer of polyacrylamides, polyacrylates, or polyacrylic acids. In some embodiments the metal salt is in a crystalline form and may comprise sodium chloride, potassium chloride, or calcium chloride. In some embodiments the crystalline metal salt is applied such that about 6 to about 28 grams of metal salt is applied per square foot of surface coated with lubricious coating. In some embodiments the admixture of metal salt and lubricious coating is removed with a garden hose water stream, scraper, broom, brush, sponge, squeegee, or pressure washer water stream. In yet other embodiments, the application of the effective amount of metal salt includes the use of a high-pressure washer wherein the solution comprising the metal salt dissolved in water (e.g., about 4% to about 20% by weight of metal salt) is now used as the high pressure dispensing medium for the high-pressure washer instead of just water alone. The high-pressure metal salt solution also serves the purpose of admixing the LC with the metal salt solution in sufficient amounts to decrease the clean-up and removal time of the LC on a given substrate.

The use of the word "a" or "an" when used in conjunction with the term "comprising" in the claims and/or the specification may mean "one," but it is also consistent with the meaning of "one or more," "at least one," and "one or more than one." Similarly, the word "another" may mean at least a second or more.

DESCRIPTION OF ILLUSTRATIVE EMBODIMENTS

I. Metal Salts

Metal salts useful in the present invention suitably include salts of alkali metals, i.e., lithium (Li), sodium (Na), potassium (K), rubidium (Rb), cesium (Cs), and francium (Fr) and of alkaline earth metals, e.g., beryllium (Be), magnesium (Mg), calcium (Ca), strontium (Sr), and barium (Ba). In typical embodiments, sodium or potassium salts are used, most typically sodium chloride or potassium chloride. The metal salts of the present invention are generally available commercially and may suitably be applied as crystalline solids, in a slurry, typically an aqueous slurry having some undissolved metal salt or as a totally dissolved metal salt solution. In non-limiting aspects, the percentage can be calculated by weight or volume of the total composition. A person of ordinary skill in the art would understand that the concentrations can vary depending on the addition, substitution, and/or subtraction of the metal salts to the disclosed methods and compositions, or in a dissolved solution.

In some embodiments, the slurry, aqueous slurry, or dissolved solution is composed by weight of about 4%, 5%, 6%, 8%, 10%, 15%, 20%, 25%, 30%, 35%, 40%, 45%, 50%, 55%, 60%, 65%, 70%, 75%, 80%, or about 85% or any range derivable therein, of at least one of the metal salts or combination thereof. In non-limiting aspects, the percentage can be calculated by weight or volume of the total composition per the slurry or dissolved solution. A person of ordinary skill in the art would understand that the concentrations can vary depending on the addition, substitution, and/or subtraction of the metal salts to the disclosed methods and compositions. or any range derivable between these percentages, by weight of metal salt or less with the balance of the composition being composed of water and, optionally, the inclusion of any other ingredient that will not interfere with the performance of the metal salt. In various embodiments, the slurry comprises about 85% or less by weight of the metal salt as described above with the balance of the composition being composed of water and, optionally, the inclusion of any other ingredients that will not interfere with the performance of the metal salt. In some embodiments, the dissolved solution of water and metal salt is composed of about 4% to about 20% by weight of the metal salt and it can be applied using a pressure washer where the dissolved solution is used as the high-pressure medium or dispensing stream instead of just water alone. In yet other embodiments, crystalline solids are particulate crystalline solids, wherein in some embodiments the mean particle size is within the range of from about 0.01 mm to about 1.50 mm. Particle size can be measured directly by use of a scanning electron microscope (SEM), optical microscope or similar method. Alternatively, particle size can also be characterized using a mechanical or vibratory sieve or screen. Embodiments include wherein the mean particle shape is substantially irregular or is substantially spherical. Salts are not limited by the anion and suitably include halides (e.g., chlorides, bromides, iodides), sulfates and the like.

While the present invention is not limited to any one theory, it is believed that the released metal ions from the metal salt tend to position themselves along the polymer chains at specific cross-link sites. These structural cross-link sites, among other factors, place a limit on the ability of the polymer to swell in the presence of water. Further, as a secondary benefit, the presence and concentration of these metal ions also tends to contaminate and then weaken the favorable intermolecular bond sites, most likely hydrogen bonds, of the wet LC polymer, thus also weakening the internal cohesion within the hydrated polymer as well as the surface adhesion between the hydrated polymer and the substrate, i.e., the surface upon which the LC is applied. Thus, the invention encompasses any salt that may provide suitable metal cations to produce this effect.

The metal salt may be applied to the LC in any amount sufficient to disrupt the adhesion between the LC and the substrate to facilitate removal. In some embodiments, the metal salt is applied at a concentration of from about 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 40, 45, 50, 60, 70, 80, 90, or about 100 grams of metal salt per square foot of surface coated with LC, or any range derivable therein. In some preferred embodiments, the metal salt is applied at a concentration of from about 6 to about 28 grams of salt per square foot of surface coated with LC. In some embodiments an effective amount of a metal salt is applied. An effective amount of a metal salt is that amount that decreases the amount of time and/or work necessary to clean-up a dispersed LC from a surface, that in some embodiments is when the high-pressure washer (about 2500 psig) clean-up time is reduced by about 30%, about 40%, or about 50%, or any range derivable between these percentages, or in some embodiments allows for the clean-up and removal of dispensed LC using a wet sponge, push broom, or garden hose without the aid of using a scraper. In other embodiments where an aqueous slurry or dissolved solution is applied to the LC, an effective amount of metal salt is the amount of metal salt applied per square foot of lubricious coating minus the water component if in a slurry or dissolved solution. For example, if a 20% by weight of metal salt solution was applied to the LC in a concentration of 100 grams of solution per square foot of surface coated with the LC, then the effective amount of actual metal salt applied per square foot of surface coated with LC would be about 20 grams (e.g., 100 grams solution*0.2 grams metal salt/1 gram solution).

As used throughout this application, the term "solution" is defined as comprising one or more metal salts as described above dissolved in water and, optionally, the inclusion of any other ingredients that will not interfere with the performance of the metal salt.

The terms "about" or "approximately," as used throughout this application, are defined as being close to as understood by one of ordinary skill in the art, and in one non-limiting embodiment the terms are defined to be within 10%, preferably within 5%, more preferably within 1%, and most preferably within 0.5%.

It is contemplated that the salts of the invention may be used in combination with other components that might be of assistance in facilitating removal of the LC.

A person of ordinary skill would recognize that the compositions of the present invention can include any number of combinations of compounds, agents, and/or ingredients, or derivatives described in the specification.

II. Lubricious Coatings

Lubricious coatings, also sometimes called anti-traction materials, are disclosed in non-limiting aspects in U.S. Application Publication Nos. 2003/0144407, 2004/0059043, and 2004/0151909, all incorporated herein by reference. Some lubricious coatings for use in the methods of the present invention also include those described below. Of course, any lubricious coating which can be removed by the methods and compositions of the invention are encompassed within the invention.

A lubricious coating composition, as described in the above references, may be formed of two components: (1) a polymer particle (Component 1), such as, for example, an acrylic polymer particle, and (2) water or the like substance, or alternatively glycerol or oil, as Component 2. The following discusses in detail the two components, as well as preferred ratios of these two components in the LC composition.

Component 1 may be an acrylic polymer particle, preferably an anionic acrylamide polymer powder, an acrylate polymer, and copolymers of polyacrylamides, polyacrylates, and polyacrylic acids (especially in an anionic form) or combinations thereof. Component 2 may be water or the like substance, or alternatively glycerol or oil. Component 1 may be combined with Component 2 to produce a lubricious coating.

Upon hydration, the viscosity of Component 1 increases to form a gel-like substance. Typical properties of Component 1 include its "stickiness," or "viscoelasticity", i.e., its ability to return to its original shape after being displaced, its rapid gel time, and the fact that the polymer chains relax and swell upon hydration. Examples of preferred acrylic polymers include Superfloc A-120, Superfloc A-130, and Superfloc A-150HMW, all products of Cytec Ind. Another example is Magnafloc 1011, Ciba, Inc.

In various exemplary embodiments, Component 1 may be granular solids that range from about 0.05 millimeters (mm) to about 0.5 mm in size. Preferably, for optimum performance, in an exemplary embodiment, the solid polymer particle should be ground or milled to a mean size of less than about 0.425 mm.

Component 2 in the LC composition may be water or the like substance, or alternatively glycerol or oil. In various exemplary embodiments, the water, or alternatively glycerol or oil, is preferably added to the dispensing polymer particles/powder en route to the targeted surface at a preferred ratio of about 8 parts water to about one part polymer particles/powder (by weight). In various exemplary embodiments, water, or alternatively glycerol or oil, can be added to the polymer particles/powder in ratios ranging from as little as about 7 parts water, or alternatively glycerol or oil, to one part polymer particles/powder to ratios as high as about 16 parts water, or alternatively glycerol or oil, to one part polymer particles/powder.

As Component 1, for example, the acrylic particle powder, becomes hydrated, the swollen particles greatly limit mobility. Unlike wet ice, it is more difficult to adjust one's stride or velocity to prevent slipping and falling, regardless of footwear or treaded tires, especially on hard or compacted surfaces. On uncompacted surfaces and soils, cleated shoes, steel studded tires, or tank treads may be able to possibly penetrate the film to a more trackable, passable and maneuverable condition, but not without considerable difficulty and not without still having the progress significantly impaired due to the slippery conditions imparted by the LC.

When applied to hard surfaces, such as, for example, asphalt, concrete and compacted soils, the combined water and swollen Component 1 particles are very effective in preventing mobility and access to controlled sites regardless of speed, footwear, or vehicle wheel structures. The LC may be equally effective on flat and sloping surfaces, as well as on grassy terrain, either mowed or heavily vegetated.

The LC composition is preferably made by combining Component 1, for example, the polymer particle, with Component 2, for example water, at the time of application to a targeted surface. Alternatively, Component 1, for example, the acrylic polymer or copolymer particles, and Component 2, for example, water, may be applied to a target surface as two distinct materials, and allowed to gel on the target surface, provided they are applied at the correct mixing ratio. For example, Component 2 (e.g., water) may be first applied to the target surface and then, Component 1 (e.g., polymer powder) may be applied to the already wet target surface. Next, Component 2 (e.g., water) may be once again applied to the wet target surface having Component 1 (e.g., polymer powder). One of the performance advantages observed by the inventors when the LC was applied in this manner was that the LC gelled much quicker, thereby reducing the time from application to operational readiness.

The LC may also comprise other components added into either the Component 2 (e.g., water) and/or as a separate component as desired and/or needed. For example, malodorants, other noxious chemicals, colorants (e.g., to camouflage the material), etc. can also be added to the LC composition. Preferably, such additional components are included in amounts that are effective without destroying the lubricious and/or stickiness properties of the lubricious coating. However, slight reductions in lubriciousness may be tolerated. It is also preferred that the additional components not destroy the environmental friendliness of the LC.

When the LC composition is applied to smooth non-porous surfaces such as concrete or tile, Component 2 (e.g., water, glycerol, oil) may be added at a ratio of about 8 parts of water to about 1 part of Component 1 (e.g., acrylic polymer particle powder) (by weight). Alternatively, when the LC composition is applied to rough, porous surfaces, the preferred ratio ranges from about 10 parts of Component 2 (e.g., water, glycerol, oil) to about 1 part of Component 1 (e.g., acrylic polymer particle powder) (by weight) on asphalt to about 16 parts of Component 2 (e.g., water, glycerol, oil) to about 1 part of Component 1 (e.g., acrylic polymer particle powder) (by weight) on grass.

Component 2 (e.g., water, glycerol, oil) and Component 1 (e.g., acrylic polymer particle powder) may be combined/mixed together immediately prior to application to a targeted surface. If Component 2 (e.g., water, glycerol, oil) is mixed with Component 1 (e.g., acrylic polymer particle powder) in the delivery system prior to dispensing, gellation and/or clogging of the parts of the delivery system most likely will occur. Since Component 2 (e.g., water, glycerol, oil) and Component 1 (e.g., acrylic polymer particle powder) should be kept separated until dispensed, a mixing nozzle may be required that allows the two material streams to be mixed together at an exit point of the nozzle. As noted above, Component 2 (e.g., water, glycerol, oil) may also be mixed with Component 1 (e.g., acrylic polymer particle powder) after Component 1 (e.g., acrylic polymer particle powder) has been applied to a targeted surface that has been pre-wetted with Component 2 (e.g., water, glycerol, oil).

Notwithstanding the preferred ratios of Component 1 to Component 2 mentioned above, in other embodiments, the ratio of Component 1 to Component 2 ranges from about 7 parts water, or alternatively glycerol or oil, to one part polymer particles/powder to ratios as high as about 16 parts water, or alternatively glycerol or oil, to one part polymer particles/powder.

There are several means by which the LC may be delivered for use on hard surfaces. The LC can be pumped, sprayed, poured, or even air-dropped to the desired location. In one embodiment, once the Component 1 and Component 2 are mixed together, the lubricious property takes effect. The required thickness of the applied LC depends on several factors including the type of surface that it is being applied to, such as, for example, asphalt, wood, concrete, grass and the like, the surface temperature, and the porosity of the surface. For example, for the LC to be effective on asphalt, a minimum thickness of about 0.030" may be applied, whereas on tile, a minimum thickness of about 0.009" may be applied. Persons of skill in the art will appreciate the ranges of thicknesses required for different surface applications. Thickness ranges of about 0.005" to about 0.050" are contemplated by the present invention.

The duration of applied LC may be a function of at least the target surface temperature, the humidity, the target surface's water permeability and the thickness of the LC applied to the surface. In various exemplary embodiments, the time duration for which the LC mixture of Component 1 and Component 2 retains its properties and characteristics, and thus its effectiveness, ranges from about thirty minutes (from the material's initial application) at about 100° F. to about four hours (from the material's initial application) at about 80° F. on a porous concrete surface. Regardless of duration constraints alone, the LC is generally effective within the temperature range of about 35° F. up to about 100° F. and within a typical indoor or outdoor humidity range of about 6% to about 90%.

Various oils, such as, for example, soybean oil, vegetable oil, canola oil and the like, may also be added to the polymer and water solution (when Component 2 is water) to increase the duration of the applied LC. Because the oil generally floats to the top of the mixture, it reduces the water evaporation rate in the LC composition mixture, when Component 2 is water.

The LC may be used to slow or hinder the forward movement of others in several ways. First, the LC may be positioned in or around an area into which one desires to keep others from entering. It is preferred that in such circumstances that the LC be positioned on hard surfaces such as concrete, asphalt, compacted soils, etc.

When the LC is dispersed on such surfaces, one finds it extremely difficult, if not impossible, to enter into the restricted area over or through the LC because a person or vehicle is unable to obtain any traction or friction with the LC. As such, the person is unable to propel in any direction, forward, back, etc., since the force of friction between the body and the lubricious coating is minuscule.

LC's are, by their very definition, characterized by their slipperiness. Means of measuring the degree of slipperiness are well known to persons of skill in the art. One means of measuring slipperiness is by determining the coefficient of friction between the coating and another object. The coefficient of friction is a dimensionless scalar value that describes the ratio of the force of friction between two bodies and the force pressing them together. The coefficient of friction is an empirical measurement in that it must be measured experimentally, and cannot be found through strict calculations alone. Static friction (sometimes called stiction) occurs when the two bodies are not moving relative to each other (like a large boulder sitting at rest on the ground). Kinetic (often called dynamic) friction occurs when two bodies are moving relative to each other and rub together (like a moving sled on the ground). As a general rule, rougher surfaces tend to have higher values and smoother surfaces tend to have lower coefficient values. Most dry materials in combination give friction coefficient values from 0.3 to 0.6. A coefficient of friction value of 0.0 indicates there is no friction present at all between the two surfaces. Rubber in contact with some surfaces can yield static friction coefficients from 1.0 to as high as 2.0. Teflon in contact with Teflon tends to have a kinetic coefficient of friction of about 0.04 while ice in contact with ice tends to have a kinetic coefficient of about 0.03. One common way to reduce friction and improve slipperiness is by using a lubricant, such as the lubricious coating described in the present invention. The LC is placed between two surfaces, such as a rubber vehicle wheel and the substrate or a rubber shoe sole and the substrate for example, to dramatically lessen the coefficient of friction. Note that the science of friction and lubrication is called Tribology. While not measured directly, embodiments in the present invention, based upon historical field tests, seem have a kinetic coefficient greater than 0.00 but less than about 0.03. See Serway, Physics for Scientists & Engineers, 3$^{rd}$ Ed., for a table of coefficient values for various combinations of materials.

Once the lubricious coating is adequately removed from a given substrate, a re-wet test is performed to verify that there is no indication of any residual surface slipperiness and the substrate (e.g., surface) is returned to as close to its original condition as possible. On very small surface areas, a typical re-wet test is performed simply by spraying a thin water coating on the substrate using a spray bottle or the like and slowly walking or tamping the sole of a shoe on the substrate to verify LC removal as well as the absence of any undesirable slipperiness. On larger surface areas, a typical re-wet test is performed by spraying a thin water coating on the substrate using a garden hose or the like and slowly walking or tamping the sole of a shoe on the substrate to verify LC removal as well as the absence of any undesirable slipperiness. On yet larger surface areas, an additional verification step of driving a wheeled vehicle slowly over the cleaned surface area to test for adequate friction between the drive wheels and the re-wet surface area is accomplished prior to verifying adequate traction for wheeled vehicles.

EXAMPLES

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Example 1

Hard surfaces such as tile, concrete, brick, or asphalt typically require the use of a high-pressure washer (about 2500 psig with water as the dispensing medium) to remove a dispersed LC comprising water and the preferred composition of Superfloc A130 from the surface. Removal is typically performed at a rate of about 6 to about 11 square feet per minute, depending upon the grade or slope of the surface as well as the surface texture and topography, without the application of a metal salt to the substrate. Application of a crystalline metal salt in the prescribed amounts of about 6 to about 28 grams per square foot (e.g., about 65 to about 301 grams per square meter) of surface coated with lubricious coating tended to reduce the pressure washer clean-up time for the tested area by approximately 30% or more. Substantial portions of the LC and metal salt composition could also independently be removed with a squeegee, push broom, garden hose water stream and even with the palm of a hand or fingers to some extent. The above effects would not otherwise be possible without the use and application of a metal salt composition, since by nature the hydrated LC, especially the acrylamide and copolymers thereof, tend to be extremely sticky to most any applied surface.

The addition of the metal salts reduced the amount of work and/or time necessary to clean-up dispersed LC from hard surfaces. Addition of a metal salt also tended to weaken the internal cohesion within the hydrated polymer as well as the surface adhesion between the hydrated polymer composition and the substrate.

In this example, a typical formulation of the LC, specifically 8 parts water to 1 part polymer powder (Superfloc A-130) by weight, was applied to predetermined asphalt, concrete, tile and wood areas of about 60 square feet each. In one series of trials, crystalline sodium chloride, having a grain size composition of about 0.3 mm to 0.9 mm, was then applied in a concentration of about 12 grams of metal salt per square foot of surface coated with LC. In another series of trials, crystalline sodium chloride was applied 10 minutes, 20 minutes and 30 minutes after the LC was dispersed on asphalt, concrete, tile and wood. Similar trials were also repeated with potassium chloride. A push broom was used to further admix the applied metal salt to the LC prior to the final removal step of using the high-pressure washer. In every case, the pressure washer clean-up time for each tested substrate area was reduced by about 30% or more.

Example 2

In yet another set of trials, an aqueous slurry of sodium chloride was prepared (e.g., 70% sodium chloride concentration by weight with the balance being water). The lubricious coating, having a formulation of 8 parts water to 1 part polymer powder (Superfloc A-130) by weight, was dispersed on to asphalt concrete, tile and wood surfaces of about 120 square feet each. Next, the previously prepared aqueous slurry was applied to the wet lubricious coating in a concentration of 17.1 grams of aqueous slurry per square foot of surface coated with the LC and then admixed further with a push broom. Note that the effective amount of actual metal salt applied here per square foot of surface coated with LC was about 12 grams (e.g., 17.1 grams solution*0.7 grams metal salt/1 gram solution). An aqueous potassium chloride slurry of the same composition was also tested under similar experimental conditions and surfaces on predetermined asphalt, tile, concrete and wood areas of about 120 square feet. The sodium chloride (e.g., solid crystalline form) used in aforementioned experiments was purchased from a local supermarket (e.g., with crystal grain size and distribution of about 0.3 mm to about 0.9 mm) having one composition comprising some iodine and another with no iodine present. The potassium chloride was also purchased at a local supermarket in the form of water softener granules and then ground down to a size distribution of about 0.05 mm to about 0.9 mm. Both metal salt compositions worked equally well in terms of improving LC clean-up and removal when using the high-pressure washer (about 2500 psig with water as the dispensing medium). In every case, the application of a metal salt slurry weakened the surface adhesion between the LC and the substrate sufficiently to then use a sponge, broom, scraper, squeegee, brush, or pressure washer to more easily remove the LC from the substrate. Independently, the application of the metal salt slurry to the LC/substrate reduced the subsequent high-pressure washer time associated with LC clean-up and removal for each of the tested substrates and areas by about 30% or greater based upon the above examples.

Example 3

The crystalline forms of sodium chloride and potassium chloride, similar in size composition per the previous examples, were also independently tested in two separate trials with a high-pressure washer stream on a lubricious coating composition (8 parts water to 1 part polymer powder, Superfloc A-130, by weight). However, in each of these independent trials, the crystalline forms of the metal salt were first dissolved in water within a storage tank, typically used on some portable high-pressure water systems. Here, in this example, the dissolved metal salt was used as the dispensing medium in lieu of just water alone to take advantage of directly using the suspended ions within the dispensing stream of high-pressure water to aid in LC removal. Each dissolved solution per each separate trial had a concentration of about 10% by weight of metal salt. The metal salt dispensing stream reduced the high-pressure washer removal time by about 30% or greater as well for the 60 square foot asphalt and smooth concrete substrate areas tested.

Example 4

In this example, the crystalline form of sodium chloride (similar composition per previous examples) was first dissolved in water to prepare a 20% by weight solution of metal salt. Next, the LC, having a composition of 10 parts water to 1 part polymer powder (Superfloc A-130) by weight, was dispersed onto asphalt, concrete, tile and wood areas of about 120 square feet each. The 20% by weight of metal salt solution was then applied to the LC in a concentration of 100 grams of solution per square foot of surface coated with the LC and then admixed further with a push broom. Note that the effective amount of actual metal salt applied here per square foot of surface coated with LC was about 20 grams (e.g., 100 grams solution*0.2 grams metal salt/1 gram solution). The application of the dissolved metal salt composition and suspended ions to the defined LC/substrate area reduced the effort to remove the LC from the substrate when using a sponge, broom, scraper, squeegee, or brush. Further, other independent tests using the high-pressure washer (about 2500 psig using water as the dispensing medium) reduced the LC removal time on asphalt, concrete, tile and wood by about 30% or greater as well for each 120 square foot substrate area tested.

Example 5

Per this example, the crystalline form of calcium chloride (0.3 to 1.2 mm in size) was independently tested and applied to the wet LC/substrate on asphalt and smooth concrete with a concentration of about 12 grams per square foot of surface coated with lubricious coating. The application of the metal salt composition to the LC/substrate reduced the effort to remove the LC (10 parts water to 1 part polymer powder, Superfloc A-130, by weight) from the substrate when using a sponge, broom, scraper, squeegee, or brush. Further, other independent tests using the high-pressure washer (about 2500 psig using water as the dispensing medium) also reduced the LC removal time by about 30% or greater as well per each of the 60 square foot substrate areas tested.

What is claimed is:

1. A method compnsing:

applying a composition comprising a metal salt to a lubricious coating disposed on a substrate, said lubricious coating comprising a mixture of polymer particles having a size of about 0.05mm to about 0.5mm, and at least one of water, glycerol or oil, said coating having a kinetic coefficient of friction less than 0.03; and physically removing at least a portion of said lubricious coating from said substrate after application of the composition comprising the metal salt.

2. The method of claim 1, wherein said polymer comprises an anionic acrylamide.

3. The method of claim 1, wherein said polymer comprises a copolymer of polyacrylamides.

4. The method of claim 1, wherein said substrate is a horizontal surface, a vertical surface, or a sloping surface.

5. The method of claim 1, wherein said substrate is asphalt, concrete, brick, tile, or wood.

6. The method of claim 1, wherein said substrate is a surface of a building structure, a tool, or machinery.

7. The method of claim 1, wherein said metal salt is an alkali metal salt or alkaline earth metal salt.

8. The method of claim 1, wherein said metal salt is a sodium salt, a potassium salt, or a calcium salt.

9. The method of claim 1, wherein said metal salt is sodium chloride, potassium chloride, or calcium chloride.

10. The method of claim 1, wherin the composition is use as a dispensing medium for a pressure washer instead of just water alone.

11. The method of claim 1, wherein said metal salt is a particulate crystalline material.

12. The method of claim 1, wherein said composition comprising the metal salt is applied such that about 6to about 28grams of metal salt is applied per square foot of surface coated with said lubricious coating.

13. The method of claim 1, further comprising admixing the applied composition comprising a metal salt with said lubricious coating.

14. The method of claim 1, wherein said physically removal comprises the use of a pressure washer water stream, sponge, broom, scraper, brush, or a garden hose water stream.

15. The method of claim 1, wherein said composition further comprises a second metal salt.

16. The method of claim 1, wherein said composition comprising the metal salt is a crystalline material, an aqueous slurry, or a dissolved solution.

17. The method of claim 11, wherein said particulate crystalline material has a mean particle size within a range of from about 0.01mm to about 1.50mm.

18. The method of claim 11, wherein a mean particle shape of said particulate crystalline material is substantially iffegular.

19. The method of claim 11, wherein a mean particle shape of said particulate crystalline material is substantially spherical.

20. The method of claim 16, wherein said dissolved solution comprises about 4% to about 20% by weight of metal salt dissolved in water.

21. A method comprising:

(a) applying a metal salt in a crystalline form, as an aqueous slurry, or as a dissolved solution comprising about 4% to about 20% by weight of metal salt dissolved in water to a surface of a lubricious coating disposed on a substrate, said lubricous coating comprising a mixture of a polymer particles having a size of about 0.05mm to about 0.5mm and at least one of water, glycerol or oil, said coating having a kinetic coefficient of friction less than 0.03;

(b) admixing said metal salt with said lubricious coating; and (c) physically removing at least a portion of the admixture of the metal salt and lubricious coating from said substrate.

22. The method of claim 21, wherein said lubricious coating comprises water and a polymer or copolymer of polyacrylamides.

23. The method of claim 21, wherein said metal salt is in a crystalline fonm

24. The method of claim 21 wherein said metal salt is applied such that about 6 to about 28 grams of metal salt is applied per square foot of surface coated with said lubricious coating.

25. The method of claim 21, wherein said admixture of metal salt and lubricious coating is removed with a garden hose water stream, scraper, broom, brush, sponge, or a pressure washer water stream.

26. The method of claim 23, wherein the crystalline metal salt comprises sodium chloride, potassium chloride, or calcium chloride.

27. A method comprising:

(a) applying a lubricious coating to a substrate, wherein the lubricious coating comprises a mixture of a polymer particles having a size of about 0.05mm to about 0.5mm and at least one of water, glycerol or oil having a kinetic coefficient of friction less than 0.03, and (b) removing at least a portion of said lubricious coating from the substrate comprising applying a composition comprising a metal salt to said lubricious coating, wherein said composition comprises a crystalline material, an aqueous slurry, or a dissolved solution comprising about 4% to about 20% by weight of said metal salt dissolved in water.

28. A method comprising:

applying a composition comprising a metal salt to a lubricious coating disposed on a substrate, said lubricious coating comprising a mixture of a polymer particles having a size of about 0.05mm to about 0.5mm and at least one of water, glycerol or oil, said coating having a kinetic coefficient of friction less than 0.03, wherein said composition is further defined as comprising a crystalline material, an aqueous sluffy, or a dissolved solution comprising about 4% to about 20% by weight of said metal salt dissolved in water; and physically removing at least a portion of said lubricious coating after application of the composition comprising the metal salt.

* * * * *